United States Patent [19]

Wolfe et al.

[11] Patent Number: 4,713,642

[45] Date of Patent: Dec. 15, 1987

[54] FACE CONNECTED INSTRUMENT TRANSFORMER

[75] Inventors: William R. Wolfe, Mt. Lebanon; David Marschik, Wilkins Township, Allegheny County, both of Pa.

[73] Assignee: Westinghouse Electric Corp., Pittsburgh, Pa.

[21] Appl. No.: 860,711

[22] Filed: May 7, 1986

[51] Int. Cl.[4] ..... H01F 27/04; H01F 29/02

[52] U.S. Cl. ..... 336/92; 336/107; 336/142; 336/175; 336/192; 361/38; 361/392

[58] Field of Search ..... 336/105, 107, 192, 142, 336/174, 175, 90, 92; 310/71; 339/18 P, 18 R, 31 R, 31 M, 32 R, 32 M; 361/392, 393, 394, 396, 417, 419, 35, 38

[56] References Cited

U.S. PATENT DOCUMENTS

| | | | |
|---|---|---|---|
| 1,741,265 | 12/1929 | Wappler | 336/107 X |
| 2,149,529 | 3/1939 | LaFave | 336/107 X |
| 2,590,821 | 3/1952 | Kiser | 336/192 X |
| 2,878,433 | 3/1959 | Beresford | 336/192 |
| 3,034,000 | 5/1962 | Todd | 336/107 X |
| 3,246,272 | 4/1966 | Wiley | 336/192 |
| 3,581,259 | 5/1971 | Burnside | 336/192 X |
| 3,996,546 | 12/1976 | Hugly | 336/107 |
| 4,156,222 | 5/1979 | Rossman et al. | 336/192 X |
| 4,232,260 | 11/1980 | Lambkin | 336/107 X |

OTHER PUBLICATIONS

Radio and Television, Jan. 1940, "2-Band Coil," Frederick Price, p. 532.

*Primary Examiner*—Thomas J. Kozma
*Attorney, Agent, or Firm*—L. P. Johns

[57] ABSTRACT

A face connected instrument transformer is disclosed having a plurality of transformation ratios comprised of two primary windings and a single secondary winding. Each primary winding is electrically connected to a pair of terminals disposed adjacent to opposite faces of the transformer housing for engaging contacts within a molded case circuit breaker housing. The transformation ratio of the instrument transformer is changed by removing the instrument transformer from the circuit breaker housing and inserting the opposite face.

15 Claims, 10 Drawing Figures

FACE CONNECTED INSTRUMENT TRANSFORMER

BACKGROUND OF THE INVENTION

1. Field of the Invention

This invention generally relates to instrument transformers and more particular to instrument transformers having a plurality of primary or secondary windings exteriorly terminated on different faces of the instrument transformer housing.

2. Description of the Prior Art

Instrument transformers are generally known in the art and are typically used in metering and control circuits. They function to convert primary voltages and currents to values which are suitable for use in various types of meters, relays, control circuits and the like. Instrument transformers have been used in polyphase alternating current applications where the magnitude of the primary voltage or current is greater than 480 volts or 5 amperes, respectively. At lower magnitudes, the primary currents and voltages may be used directly. Alternatively, voltage divider networks and current shunts are used. However, use of such devices results in relatively large power dissipation and consequently such use is expensive.

Essentially, there are two types of instrument transformers: potential transformers and current transformers. Potential transformers have been used for measuring the voltage in a primary circuit and current transformers have been used for measuring the current in a primary circuit.

Both potential and current transformers are used in a wide variety of applications. For example, potential and current transformers have been used as pilot devices for voltmeters, ammeters, power factor meters, watt meters, demand meters, watt hour meters and the like. They have also been used in a variety of control circuits ranging from circuits for controlling motors to circuits for controlling the operation of metal clad switchgear breakers.

Although potential transformers and current transformers are similar in construction, they differ in their application. For example, potential transformers are connected across line conductors in a primary circuit or between a line conductor in a primary circuit and a ground conductor in a grounded system. The current flowing through the primary winding of the potential transformer is substantially less than the line current in the primary circuit. The primary winding of current transformers is normally connected in series with a line conductor. Thus, the primary winding of a current transformer will be exposed to the line current of the primary circuit.

Various conventional constructions of instrument transformers have been used. Typically, instrument potential transformers are of the wound primary type consisting of a wound primary winding and a wound secondary winding insulated from each other and permanently assembled on a laminated core. Current transformers are comprised of various types of constructions. One type is a wound primary type, similar to potential transformers. Another type is the bar type, similar to the wound primary type, except the primary winding is a single conductor. A window type, consisting only of a secondary winding, uses a line conductor as its primary winding.

Recently, there has been a trend to utilize electronic controls for molded case circuit breakers. In such electronically controlled circuit breakers, a current transformer is used to provide a current source compatible with the electronic control circuit. Due to the compactness of molded case circuit breaker, the current transformers have sometimes been mounted external to the molded case circuit breaker housing and hand wired to the electronic control circuit for the molded case circuit breaker. This results in additional labor required to install the current transformer and wire it to the electronic control circuit. Moreover, the current transformers used with such electronically controlled molded case circuit breakers are often provided with a plurality of transformation ratios which can only be changed by interconnecting portions of the windings by various means. Therefore, changing of the transformation ratios of a current transformer in the field has been quite cumbersome.

Thus, there exists a need to provide an instrument transformer having a plurality of transformation ratios which can be changed quickly and easily. There is also a need for a dimensionally small instrument transformer adapted to be received in an electronically controlled molded case circuit breaker housing for supplying current proportional to the primary current through the circuit breaker.

SUMMARY OF THE INVENTION

An object of the present invention is to provide a new and improved instrument transformer.

Another object of the present invention is provide an instrument transformer having a plurality of transformation ratios which can be changed quickly and easily.

Another object of the invention is to provide an instrument transformer having a plurality of transformation ratios which can be changed without the need for interconnecting the windings.

Another object of the present invention is to provide an instrument transformer which is dimensionally small so that it may to be received in a molded case circuit breaker housing.

Briefly, the present invention relates to an instrument transformer and more particularly to an instrument transformer having a plurality of primary windings terminated on opposite faces of the transformer housing. The instrument transformer is capable of being received in a circuit breaker frame utilized with electronically controlled molded case circuit breakers and the like, and keyed so it can be inserted into the circuit breaker housing in at least two positions; each such position corresponding to different primary winding terminals. The primary winding connection and hence the transformation ratio may be changed by removing the instrument transformer from the molded case circuit breaker housing and reinserting it in a second and different position. The secondary windings are configured so that the polarities of the secondary winding will remain the same after the transformation ratio is changed. Although the novel instrument transformer is disclosed and described herein as a current transformer with a plurality of primary windings to be used with an electronically controlled circuit breaker, the principles of the present invention are also applicable to potential transformers and to transformers with a plurality of face terminated secondary windings and to other applications as well.

BRIEF DESCRIPTION OF THE DRAWING

The above and other objects and advantages and novel features of the present invention will become apparent from the following detailed description of the preferred embodiment of an instrument transformer illustrated in the accompanying drawing, wherein.

DETAILED DESCRIPTION OF THE DRAWING

Figure 1:
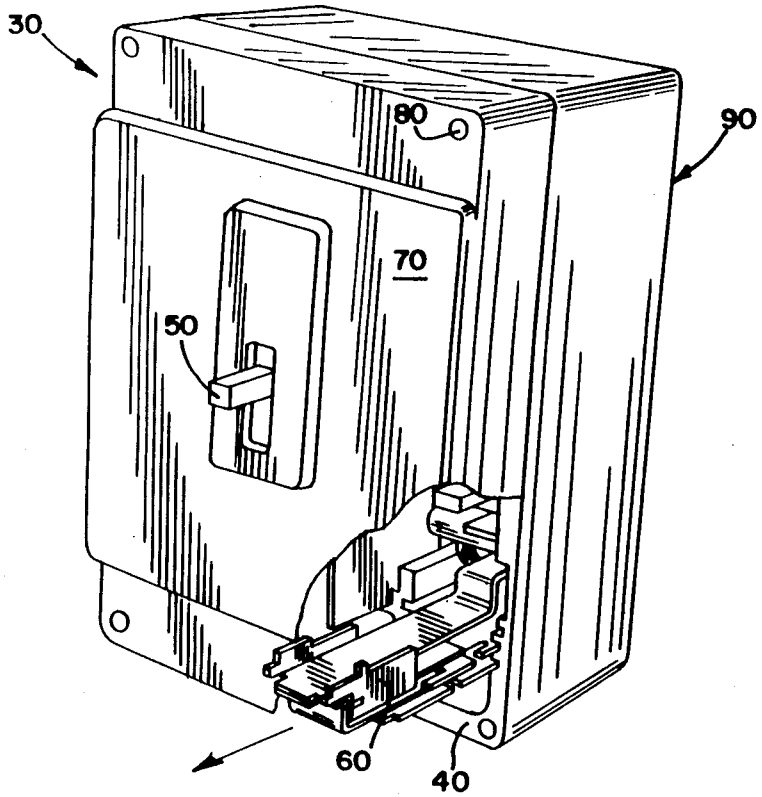
FIG. 1 is a perspective view of an electromechanically actuated molded case circuit breaker with a fragmentary, broken away section illustrating a bimetallic overload device in a position where it has been partially removed from its housing.

Referring to the drawing and first to FIG. 1, a novel instrument transformer is illustrated and generally identified by the reference numeral 20. The instrument transformer 20 using the present invention is described and illustrated in conjunction with an electronically controlled molded case circuit breaker. With minor modifications to a standard frame for a conventional circuit breaker, which will be described in some detail, the novel instrument transformer 20 is adapted to be contained within the frame, thus providing a self-contained unit.

In FIG. 1 a conventional molded case circuit breakers 30 is illustrated. Such conventional circuit breakers 30 are electromechanically actuated and are generally comprised of a frame 40, main tripping contacts (not shown), electromechanical actuators (not shown), an overcenter toggle mechanism 50, bimetallic overload devices 60, and a removable front cover 70 fastened to the frame 40 by a plurality of fasteners 80. A detailed description of an electromechanical actuated circuit breaker is contained in a copending application, Ser. No. 6/569,055, filed on Jan. 9, 1984, and assigned to the same assignee as the present invention, and is hereby incorporated herein by reference.

Figure 4:
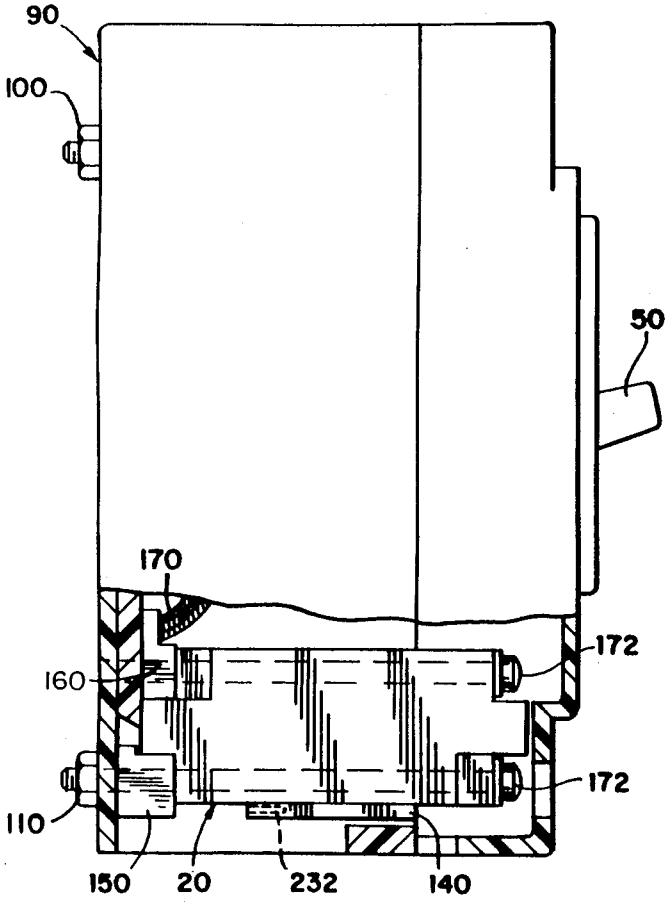
FIG. 4 is a side view of the molded case circuit breaker depicted in FIG. 3 with a fragmentary, broken away section illustrating the instrument transformer of the present invention inserted into the housing.

Three pairs of contacts (one pair for each phase) are mounted to extend through the rear wall 90 of the frame 40 and are accessible from the exterior of the housing to connect the circuit breaker into an electrical circuit. As is shown in FIG. 4, each pair of contacts is comprised of a load side contact 100 and a line side contact 110. Each load side contact 100 is connected in series with a main tripping contact, which is, in turn, connected in series with a bimetallic overload device 60. Each bimetallic overload device 60 is connected to a line side contact 110.

In electronically controlled circuit breakers, the main tripping contacts are electronically controlled. Therefore, the electromechanical actuators and the bimetallic overload devices 60 are replaced with actuators controlled by an electronic circuit (not shown). To prevent the electronic circuit from being damaged or destroyed by line currents, a current transformer is usually employed to provide the electronic circuit a lower amplitude signal proportional to the line current. In the present invention such a current transformer 20 is received within a modified circuit breaker frame. The modifications to be made may be understood by comparison with the conventional molded case circuit breaker frame illustrated in FIG. 1.

Figure 2:
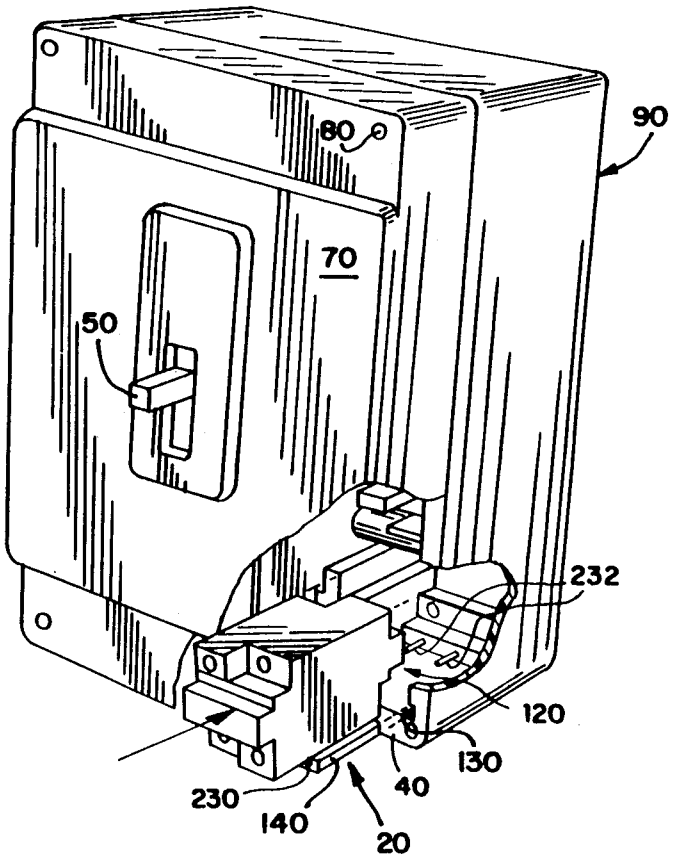
FIG. 2 is a perspective view of a molded case circuit breaker with a fragmentary, broken away section illustrating a modified housing for receiving an instrument transformer which is the subject of the present invention, the latter transformer also being illustrated in a position partially removed from the housing.
Figure 3:
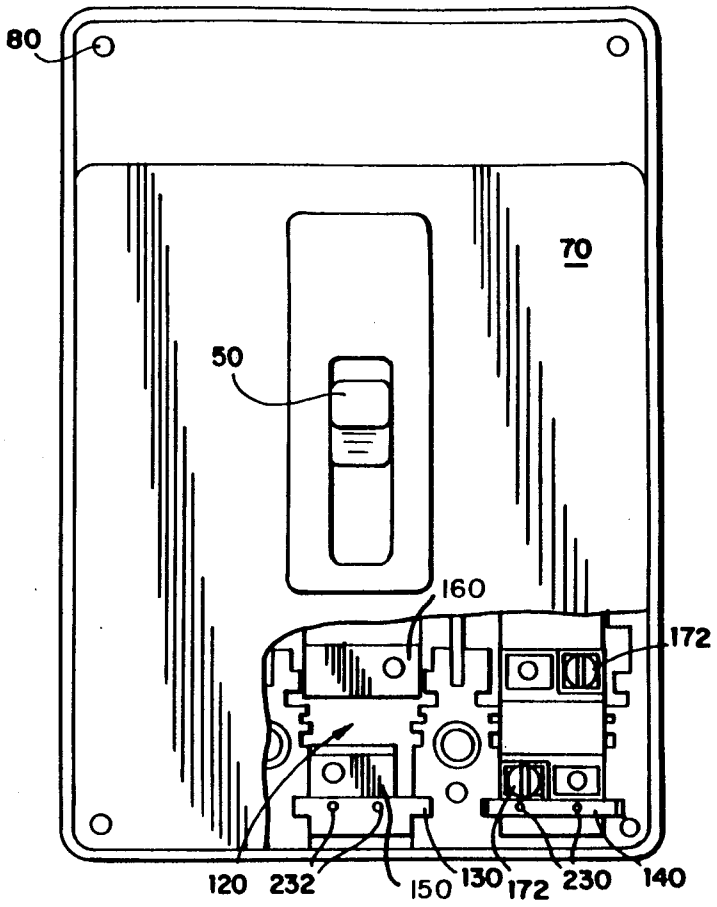
FIG. 3 is a front elevational view of a molded case circuit breaker with a fragmentary, broken away section illustrating an instrument transformer embodying the features of the present invention inserted into the housing.

Such a modified frame is illustrated in FIGS. 2–4 and includes a compartment 120 in the circuit breaker frame 40, normally occupied by the bimetallic overload device 60 of FIG. 1 in an electromechanically actuated breaker, which compartment is modified to receive the instrument transformer 20 of the present invention. The circuit breaker frame illustrated has three compartments 120 (FIG. 3). A pair of inwardly facing open slots 130 for each compartment 120 is integrally formed in the circuit breaker frame 40. These pairs of slots 130 receive the opposed side edges of a shoe 140 (FIGS. 2, 5 and 6) integrally formed with the base of the instrument transformer 20. The slots and the edges of the shoe form interfitting parts which permit selective insertion of the transformer unit into the frame in different preselected positions while preventing any such insertion in any other positions of the transformer unit. More specifically, the combination of the edges of the shoe 140 and the slots 130 permit insertion of the instrument in which the instrument transformer 20 into each of the compartments 120 in different positions, one of which is illustrated in the drawings and the other of which may be achieved by removing the instrument transformer 20 from the compartment, turning it 180° and reinserting it into the compartment with the edges of the shoe 140 again being accommodated within the slots 130.

In addition to providing the pairs of slots 130, additional hardware should be added to the standard circuit breaker frame 40. Specifically, pairs of contacts 150, 160 should be disposed within each of the compartments 120 for making electrical connection between the instrument transformer 20 and the circuit breaker 30. Each pair of contacts 150 and 160 are generally comprised of copper and provide a flush coplanar mounting surface for the instrument transformer 20. As is illustrated in FIG. 3, the instrument transformer 20 is inserted into a cavity adjacent the contacts 150 and 160.

The contact 150 may be electrically connected by conventional means to the line side contact 110 while the contact 160 is electrically connected to the main tripping contact by way of a braided copper wire 170. Each of the contacts 150 and 160 contains an aperture for receiving a fastener 172 for positioning and holding the instrument transformer 20 in the compartment 120. As an alternative, the instrument transformer may be held in place by the circuit breaker cover 70. As should be apparent from the foregoing description, the modifications to a conventional circuit breaker frame to permit it to accept the current transformer 20 are minimal.

FIGS. 5–8 illustrate the instrument transformer 20 of the present invention which has a unique geometrical housing 180 formed by conventional potting or injection molding processes. The housing 180 is elongated and is generally rectangularly shaped with a pair of oppositely disposed, generally parallel end faces 182, 184. Each of the end faces is formed with a plurality of offset parallel surfaces all of which are essentially perpendicular to the longitudinal axis of the housing 180. The offset surfaces on the faces 182 define a pair of shoulders 190 as well as a pair of insets 220. The corresponding surfaces on the end face 184 also define similar pairs of shoulders 200 and corresponding insets 210. The pair of shoulders 190 disposed on face 182 are parallel to and axially aligned with the pair of insets 210 on face 184. Similarly, the pair of insets 220 on face 182 are parallel to and axially aligned with the pair of shoulders 200 on the face 184. On the face 182, the pair of shoulders 190 are coplanar and parallel with the pair of coplanar insets 210 and the same is true of the shoulders and insets on the face 184.

As herein described, the instrument transformer 20 contains two primary windings and a single secondary winding disposed within the housing 180. Each primary winding is electrically connected to terminals disposed on faces 182 and 184. For clarity, the pair of terminals of one of the primary windings are identified by the numeral 186 while the pair of terminals for the second primary winding are identified by the reference numeral 188. Referring to the face 182 initially, each of the terminals 186 protrudes beyond the surface of a shoulder 190. Each of the terminals 188 protrudes beyond the face of one of the insets 220. Referring to the face 184, the pair of terminals 186 are located on the insets 210 and the pair of terminals 188 are located on the shoulders 200.

The terminals 186, 188 disposed on the faces 182 and 184 are adapted to make electrical connection with the contacts 150 and 160 disposed within the circuit breaker frame 40. As earlier discussed, the shoe 140 and the pairs of slots 130 permit insertion of the instrument transformer 20 into the compartment 120 in two different positions, that is, with either face 182 or 184 engaging the contacts 150 and 160. When the instrument transformer 20 is fully inserted into the compartment 120 only terminals carried by the pairs of shoulders 190, 200 can engage or make electrical contact with the contacts 150 and 160. As is shown best in FIG. 4, the terminals carried by the insets 210, 220 are spaced away from the contacts 150, 160 when the instrument transformer is fully inserted, regardless of which face 182, 184 first enters the compartment 120. Thus, it is apparent that when the contacts 150 and 160 engage the face 182, only the primary winding connected to terminals 186 is actuated. Similarly when face 184 is engaged, only the primary winding connected to terminals 188 is actuated.

In the preferred embodiment, the secondary winding is electrically connected to two pairs of terminals 230 disposed on opposite ends 240, 250 of the shoe 140. These terminals 230 are adapted to receive male terminals 232 (FIG. 3) mounted on the interior to the rear wall 90 of the frame 40 and prewired to the electronic control circuit. Thus, when the instrument transformer 20 is inserted into the compartment 120, the terminals 230 are electrically connected to the electronic circuit. Since a pair of terminals 230 are disposed on each end 240, 250 of the shoe 140 and since the terminals of each pair are equally spaced and oriented to engage the male terminals, the secondary winding is connected irrespective of which primary winding is actuated. Also, the turns of the secondary windings are wound so that the polarity remains the same regardless of which primary winding is utilized.

Figure 5:
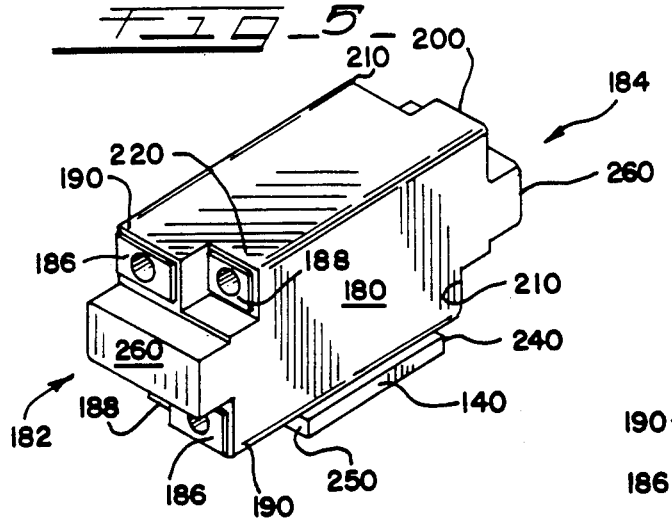
FIG. 5 is a perspective view of a preferred embodiment of an instrument transformer characterized by the features of the present invention.
Figure 6:
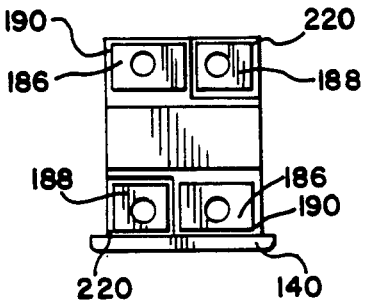
FIG. 6 is an end view of the instrument transformer illustrated in FIG. 5.

Integrally formed on each face 182 and 184 of the housing 180 is an outwardly protruding spacer 260. Each spacer 260 is comprised of a rectangular projection extending from the end of the housing 180 between terminals of each pair 186 and 188 as shown in FIG. 5. One of spacers 260 is received in a cavity defined by the spacing between the contacts 150 and 160 when the transformer 20 is inserted into the compartment 120. The spacer 260 is dimensioned to securely seat and properly position the instrument transformer housing 180 within the compartment 120 and to permit one of the pairs of terminals 186, 188 to engage a pair of contacts 150 and 160. In embodiments not containing the integrally formed shoes 140, the spacers 260 prevent insertion of the instrument transformer 20 in a position 90° rotated from that illustrated in FIG. 5. Additionally, the rectangular cross section of the instrument transformer housing 180 serves to limit the number of positions in which the instrument transformer 20 can be inserted.

Figure 9:
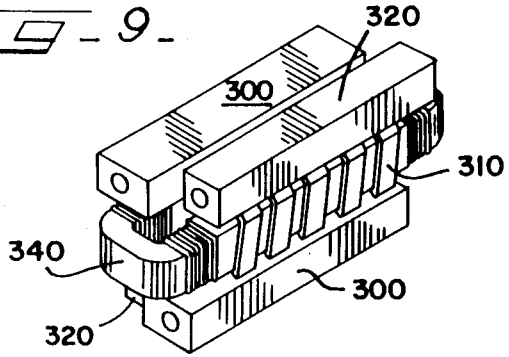
FIG. 9 is an isometric view of assembled primary and secondary windings forming an instrument transformer embodying the features of the present invention.
Figure 10:
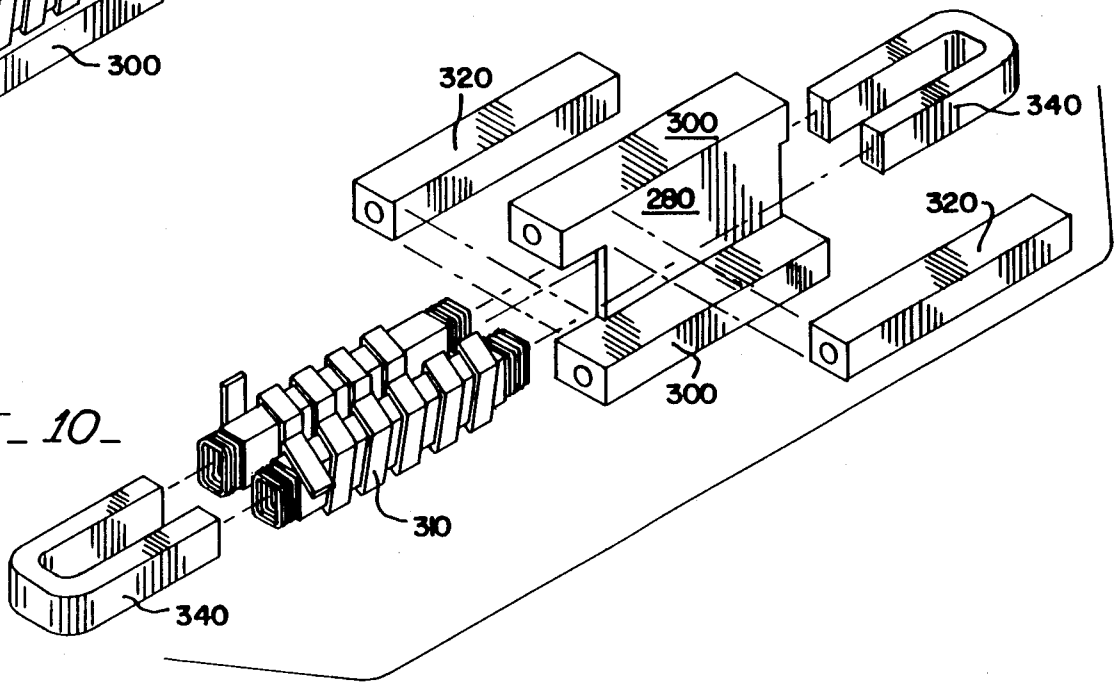
FIG. 10 is an exploded isometric view of the primary and secondary windings of the instrument transformer illustrated in FIG. 9.

Referring to FIGS. 9 and 10, the internal windings of the novel instrument transformer 20 are shown. In the preferred embodiment, two primary windings are provided. The size of the copper conductor used for each of these windings is determined by the primary circuit line current.

Figure 7:
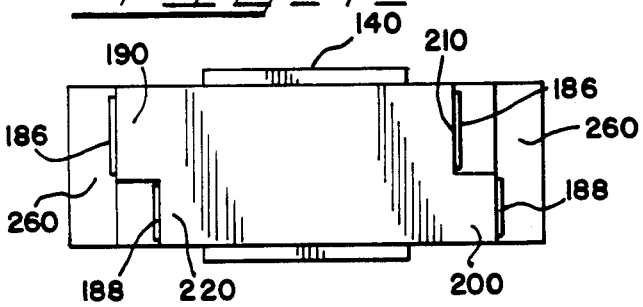
FIG. 7 is a top or plan view of the instrument transformer illustrated in FIG. 5.
Figure 8:
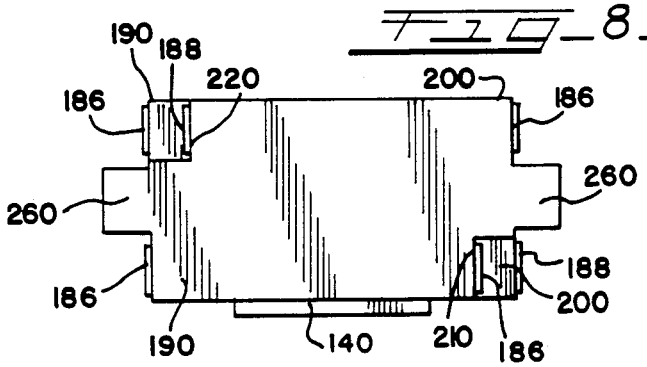
FIG. 8 is a front or elevational view of the instrument transformer illustrated in FIG. 5.

A first winding 280 comprises an elongated single turn winding. Each end of the winding 280 is electrically connected to an elongated post 300. The winding 280 also includes a second post 300. The posts 300 can be formed integral with the winding 280 or separately formed and connected thereto by conventional means. Each post 300 contains a longitudinally extending aperture. As is best seen in FIGS. 5, 7 and 8 the posts 300 extend the full length of the winding 280 and their ends project slightly beyond the offset surfaces disposed on the faces 182 and 184 of the transformer housing 180 to form the terminals 186. Thus, it can be seen that one end of the posts 300 forms the pair of shoulders 190 on the face 182 and the opposite end forms the pair of insets 210 on the face 184.

The second primary winding 310 preferably comprises of a multiple turn winding, for example, a ten turns winding as illustrated in FIG. 10. The turns are helically wound about a central axis and electrically connected to a pair of parallel posts 320 disposed adjacent and parallel to the posts 300. The posts 320 are appropriately spaced from the windings 310 to prevent shorting. The windings 310 and/or the posts 320 may also be insulated. One end of each of the posts 320 forms one of the terminals 188 on the face 184 while the opposite ends form a pair of insets 220 on the face 182.

The secondary winding turns are wound on a laminated steel oval shaped core comprising a pair of generally U-shaped ends 340 covered with fish paper. The number of secondary turns depends on the desired transformation ratios. For example, a 1500 turn secondary winding will provide transformation ratios of 1500:1 and 150:1 when used with the one turn and ten turn primary windings heretofore discussed. The size of the copper conductor forming the turns depends upon the current therethrough.

The turns of the secondary winding 330 are covered with an insulating layer to insulate them from the primary windings. The first primary winding 280 is also insulated. In the preferred embodiment, Kapton (a registered trademark of the DuPont Company) insulating film is used.

After the secondary winding 330 is wound and its turns are covered with the insulating layer, the first and second primary windings are assembled as shown in FIGS. 9 and 10 providing magnetic coupling between the primary and secondary windings. The use of two U-shaped pieces to form the laminated core facilitates the assembly. The completed assembly is potted or injection molded to provide the novel instrument transformer 20 of the present invention.

Obviously, many modifications and variations of the present invention are possible in light of the above teachings. Thus, it is to be understood that within the scope of the appended claims, the invention may be practiced otherwise than as specifically described. For example, various transformation ratios can be utilized. Also, the teachings of the present invention are equally adaptable to both potential and current transformers. All such embodiments are within the spirit and scope of the appended claims.

What is claimed and desired to be secured by Letters Patent is:

1. An instrument transformer having a plurality of transformation ratios for connection to at least one external circuit comprising:

an elongated housing having at least one face with a plurality of longitudinally offset surfaces;

a plurality of pairs of first circuit terminals disposed adjacent different ones of said surfaces such that each pair of said first circuit terminals is coplanar and longitudinally offset from each other pair of terminals;

a plurality of first circuit windings disposed within said housing, each winding electrically connected to one pair of said first circuit terminals;

one or more pairs of second circuit terminals disposed exteriorly on said housing;

one or more second circuit windings positioned within said housing in magnetic coupling relationship with at least one of said first circuit windings and electrically connected to said one or more pairs of second circuit terminals.

2. An instrument transformer as recited in claim 1 wherein said plurality of first circuit windings consists of two.

3. An instrument transformer as recited in claim 2 wherein one end of each of said first circuit windings is electrically connected to a pair of first circuit terminals, each pair of first circuit terminals being disposed on opposite faces of said housing substantially parallel to each other and axially aligned with the other pair of said first circuit winding terminals.

4. An instrument transformer as recited in claim 2 wherein each of said terminals is comprised of an elongated post having two ends extending longitudinally the length of said housing such that each end is adjacent one of said longitudinally offset surfaces.

5. An instrument transformer as recited in claim 4 wherein each of said elongated posts contains an aperture extending longitudinally therethrough.

6. An instrument transformer as recited in claim 1 wherein one of said first circuit windings comprises a single turn winding of an elongated copper conductor.

7. An instrument transformer as recited in claim 6 wherein the ends of said single turn winding are electrically connected to a pair of elongated posts extending the length of said conductor and parallel to each other.

8. An instrument transformer as recited in claim 1 wherein one of said first circuit windings comprises a plurality of turns of a copper conductor helically formed about a central axis and having its ends electrically connected to a pair of elongated posts disposed parallel to said central axis and extending the length thereof.

9. An instrument transformer as recited in claim 1 wherein said second circuit windings are formed by a plurality of turns of a copper conductor wound about a laminated steel core.

10. An instrument transformer as recited in claim 9 wherein said laminated transformer core is comprised of two portions forming an oval shaped core.

11. An instrument transformer having a plurality of transformation ratios comprising:

four pairs of primary terminals;

two primary windings each electrically connected to two pairs of said primary terminals;

a set of secondary terminals;

a secondary winding magnetically coupled to said primary windings and electrically connected to said secondary terminals;

a closed housing having two sides and two oppositely disposed faces for containing said primary windings and said secondary winding; wherein two pairs of said primary terminals, each pair electrically connected to a different primary winding, are disposed on each of said opposite faces.

12. An instrument transformer as recited in claim 11 wherein each pair of said primary terminals is coplanar and is longitudinally offset from the other pair of terminals on each of said opposite faces.

13. An instrument transformer as recited in claim 11 further including a rectangular shaped guide shoe disposed on the bottom of the housing.

14. An instrument transformer as recited in claim 13 wherein said set of secondary terminals comprises two pairs of terminals disposed on opposite sides of said guide shoe, each pair of said secondary terminals axially aligned with the pair of terminals on the opposite side.

15. An instrument transformer as recited in claim 14 wherein each of said secondary terminals is adapted to receiving pin-like terminals.

* * * * *